US007341071B2

(12) United States Patent
Lee

(10) Patent No.: US 7,341,071 B2
(45) Date of Patent: Mar. 11, 2008

(54) TENT FRAME

(76) Inventor: Yook-Hyun Lee, No. 202, Daegwang Town, Anyang-Dong, Manan-Gu, Anyang-Si, Kyunggi-Do (KR)

( * ) Notice: Subject to any disclaimer, the term of this patent is extended or adjusted under 35 U.S.C. 154(b) by 263 days.

(21) Appl. No.: 11/225,735

(22) Filed: Sep. 13, 2005

(65) Prior Publication Data

US 2006/0076045 A1 Apr. 13, 2006

(30) Foreign Application Priority Data

Oct. 9, 2004 (KR) ..... 20-2004-0028648 U

(51) Int. Cl.
*E04H 15/36* (2006.01)

(52) U.S. Cl. ..... 135/128; 135/135

(58) Field of Classification Search ..... 135/128, 135/124, 132, 133, 135, 137, 147
See application file for complete search history.

(56) References Cited

U.S. PATENT DOCUMENTS 2,766,457 A * 10/1956 Wielandt ..... 2/171.03
3,392,946 A * 7/1968 Stromberg ..... 248/171
5,230,358 A * 7/1993 Forell ..... 135/98
5,871,026 A * 2/1999 Lin ..... 135/98
6,286,530 B1 * 9/2001 Hussey ..... 135/98
2002/0092554 A1 * 7/2002 Ham et al. ..... 135/135

FOREIGN PATENT DOCUMENTS

KR 20-0275325 4/2002
KR 20-0331627 10/2003

* cited by examiner

*Primary Examiner*—David Dunn
*Assistant Examiner*—Noah Chandler Hawk
(74) *Attorney, Agent, or Firm*—Cantor Colburn LLP

(57) ABSTRACT

Disclosed herein is a tent frame. The tent frame comprises a hollow supporting body having a bottom-opened cylinder extending downward from an inner top surface thereof, a columnar slider axially coupled to the bottom-opened cylinder in a vertically movable manner and formed at an outer circumference thereof with racks, first elastic means coupled at a first end thereof to the supporting body and at a second end thereof to the columnar slider so as to provide the columnar slider with a vertical movement force, and main poles rotatably coupled around the supporting body so as to be unfolded through rotation. The main poles are formed at their first ends with pinions to engage with the racks of the columnar slider. With such a simplified structure, the tent frame of the present invention can be rapidly and easily folded or unfolded, and the completely unfolded state of the frame can be simply maintained.

7 Claims, 9 Drawing Sheets

TENT FRAME

BACKGROUND OF THE INVENTION

1. Field of the Invention

The present invention relates to a tent frame, and more particularly, to a tent frame for enabling not only more simple unfolding of poles, but also accurate and easy fixation of the unfolded poles, thereby achieving rapid and simple folding or unfolding thereof.

2. Description of the Related Art

Generally, tents are portable shelters which are easy to dismantle, carry and assemble, and are usable in various outdoor activities, such as climbing, fishing, camping, etc. The tents are classified, on the basis of their shapes, into A-shaped tents, domed tents and tunneled tents, or, on the basis of their folding or unfolding manners, into canopy-type tents and umbrella-type tents.

The canopy-type tents are referred to as foldaway tents, which are designed so that their frames are manually folded or unfolded. Such canopy-type tents are usable as simple awnings for temporary rest.

The umbrella-type tents employ the same folding or unfolding manner as umbrellas, and their completely unfolded frames are like as an unfolded umbrella. Modern automatic tents are mainly the umbrella-type tents.

Tent frames serve to support the tents from external force to maintain the completely unfolded shapes of the tents. The appearance of the tents depends on the unfolding configuration of the frames.

Various modified examples of the tent frames are disclosed in the prior art.

As one example, Korean Registered Utility Model No. 275325 discloses a foldaway frame for use in tents or awnings in which a plurality of poles and link-bars are assembled to one another so as to be easily folded or unfolded in an articulated manner.

However, the tent frame disclosed in said Korean Registered Utility Model No. 275325 has a problem in that it contains an excessive number of elements and thus suffers from frequent failures of the elements and great skill is required to assemble and disassemble them, although it provides a tent with aesthetic appearance in its completely unfolded state.

As a solution of the above described and other problems of conventional tent frames, Korean Registered Utility Model No. 331627, filed by the applicant of the present invention, discloses a foldaway automatic tent frame.

One embodiment disclosed in said Korean Registered Utility Model No. 331627 is shown in FIGS. 8 and 9.

As shown in FIGS. 8 and 9, the tent frame of said Registered Utility Model No. 331627 is characterized in that a slider 3 is slidably coupled to the outer circumference of a top supporting body 2, which is located at an uppermost position of the tent frame and has a cross sectional area increasing at a predetermined region, and poles 9*c* and 9*d* are coupled to the slider 3 so as to be unfolded as the slider 3 slides upward along the supporting body 2.

The tent frame as mentioned above, however, has a problem in that the completely unfolded poles 9*c* and 9*d* undergo stress concentration at their specific end positions, showing a high damage possibility. Further, unfolding of the poles 9*c* and 9*d* is somewhat difficult since a relatively strong force is required to upwardly push the slider 3.

Referring to FIG. 9, the tent frame of said Registered Utility Model No. 331627 comprises elastic members 8, such as springs, elastic strings, etc., mounted in poles 9*a* and 9*b*. Both ends of a respective one of the elastic members 8 are resiliently fixed, respectively, to an end of the respective poles 9*a* and 9*b*. After the poles 9*a* and 9*b* are completely unfolded, the elastic members 8 serve to maintain the unfolded state of the poles 9*a* and 9*b*. In this case, the respective poles 9*a* and 9*b* are adapted to receive rotation force generated by torsion helical springs 7. Such torsion helical springs 7 allow the poles 9*a* and 9*b* to be more easily unfolded by means the elasticity thereof.

Said Registered Utility Model No. 331627, however, has several problems. That is, the torsion helical springs are difficult to install in the poles, and the use of the elastic members increases manufacturing costs of the tent frame. Further, the elastic members tend to be deteriorated in their elasticity due to repetitive extensions thereof. Upon damage to the elastic members, all of the poles must be disassembled in order to exchange the damaged elastic members with new ones.

SUMMARY OF THE INVENTION

Therefore, the present invention has been made in view of the above problems, and it is an object of the present invention to provide a tent frame which can be readily and easily folded or unfolded by virtue of its simplified structure and can effectively maintain the unfolded state of poles.

Additional aspects and/or advantages of the invention will be set forth in part in the description which follows and, in part, will be obvious from the description, or may be learned by practice of the invention.

In accordance with the present invention, the above and other objects can be accomplished by the provision of a tent frame comprising: a hollow supporting body having a bottom-opened cylinder extending downward from an inner top surface thereof; a columnar slider axially coupled to the bottom-opened cylinder in a vertically movable manner, the columnar slider being formed at an outer circumference thereof with racks; first elastic means coupled at a first end thereof to the supporting body and at a second end thereof to the columnar slider so as to provide the columnar slider with a vertical movement force; and main poles rotatably coupled around the supporting body so as to be unfolded through rotation, the main poles being formed at their first ends with pinions to engage with the racks of the columnar slider.

Preferably, the columnar slider may include: an outer column formed at an outer circumference thereof with the racks; and an inner column concentrically inserted in the outer column, and the bottom-opened cylinder may be interposed between the outer and inner columns.

Preferably, the first elastic means may include: a tension spring installed in the inner column; and a compression spring interposed between the inner column and the bottom-opened cylinder.

Preferably, the supporting body may be formed with a switch to maintain or release a downwardly moved state of the columnar slider.

Preferably, the tent frame may further comprise: first auxiliary poles each having a first end eccentrically located relative to a center axis of an associated one of second folders; second auxiliary poles each having a first end eccentrically located relative to the center axis of the associated one of the second folders and a second end formed with a hook; first folders each having a stopper to prevent reverse rotation of the associated first auxiliary pole and main pole, to a respective one of the first folders being rotatably coupled a second end of the associated first auxiliary pole and a second end of the associated main pole; the second folders each being hingedly coupled with the first end of the associated second auxiliary pole and the first end of the associated first auxiliary pole; and second elastic means coupled at both ends thereof, respectively, to the associated first and second auxiliary poles.

Preferably, the first end of the first auxiliary pole may be formed with a recess, and the first end of the second auxiliary pole may be formed with a protrusion to be fitted into the recess.

Preferably, the second elastic means may include a tension spring.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
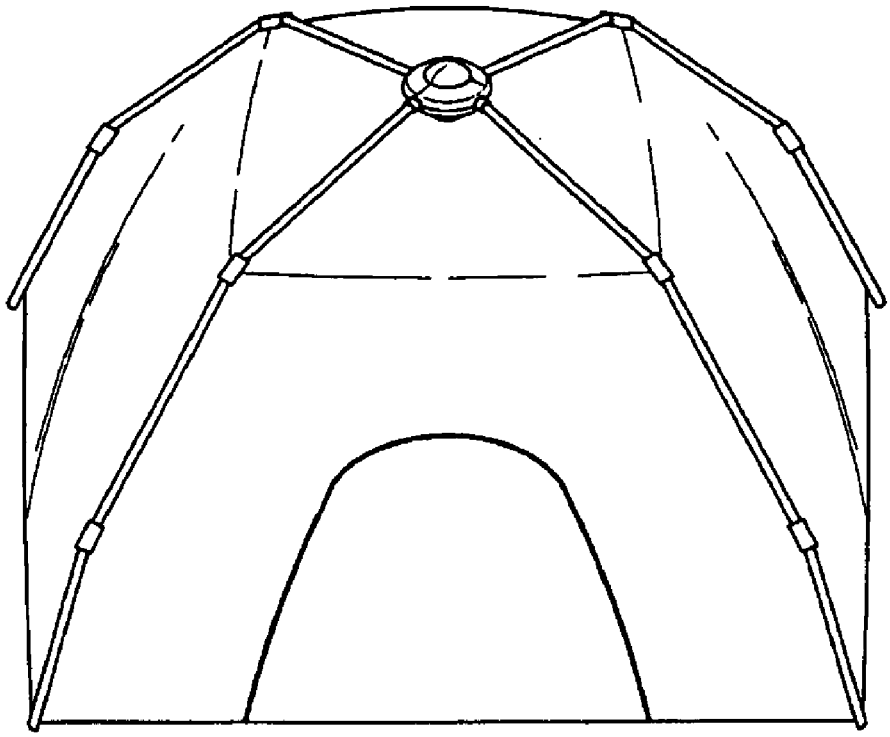
FIG. 1 is a perspective view of a tent frame according to the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

In the following description of the present invention, a detailed description of known functions and configurations incorporated herein will be omitted when it may make the subject matter of the present invention rather unclear. Also, the terms used in the following description are terms defined taking into consideration the functions obtained in accordance with the present invention. The definitions of these terms should be determined based on the whole content of this specification.

Figure 2:
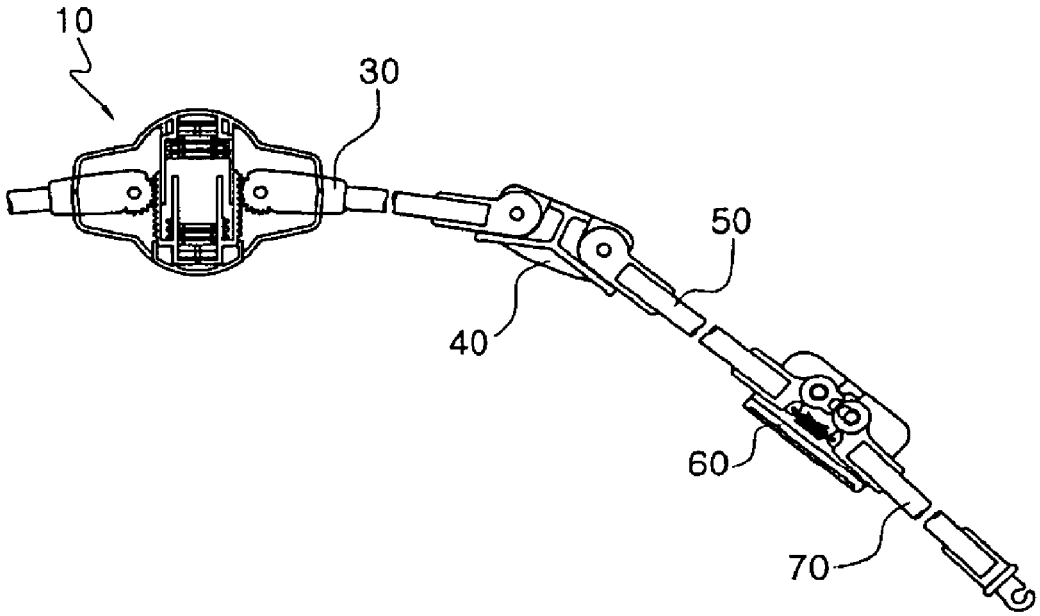
FIG. 2 is a sectional view of partial elements of the tent frame according to the present invention.

FIG. 1 is a perspective view of a tent frame according to the present invention. FIG. 2 is a sectional view of partial elements of the tent frame according to the present invention.

As shown in FIGS. 1 and 2, the tent frame of the present invention comprises a supporting body 10, main poles 30, first and second auxiliary poles 50 and 70, and first and second folders 40 and 60.

Figure 3:
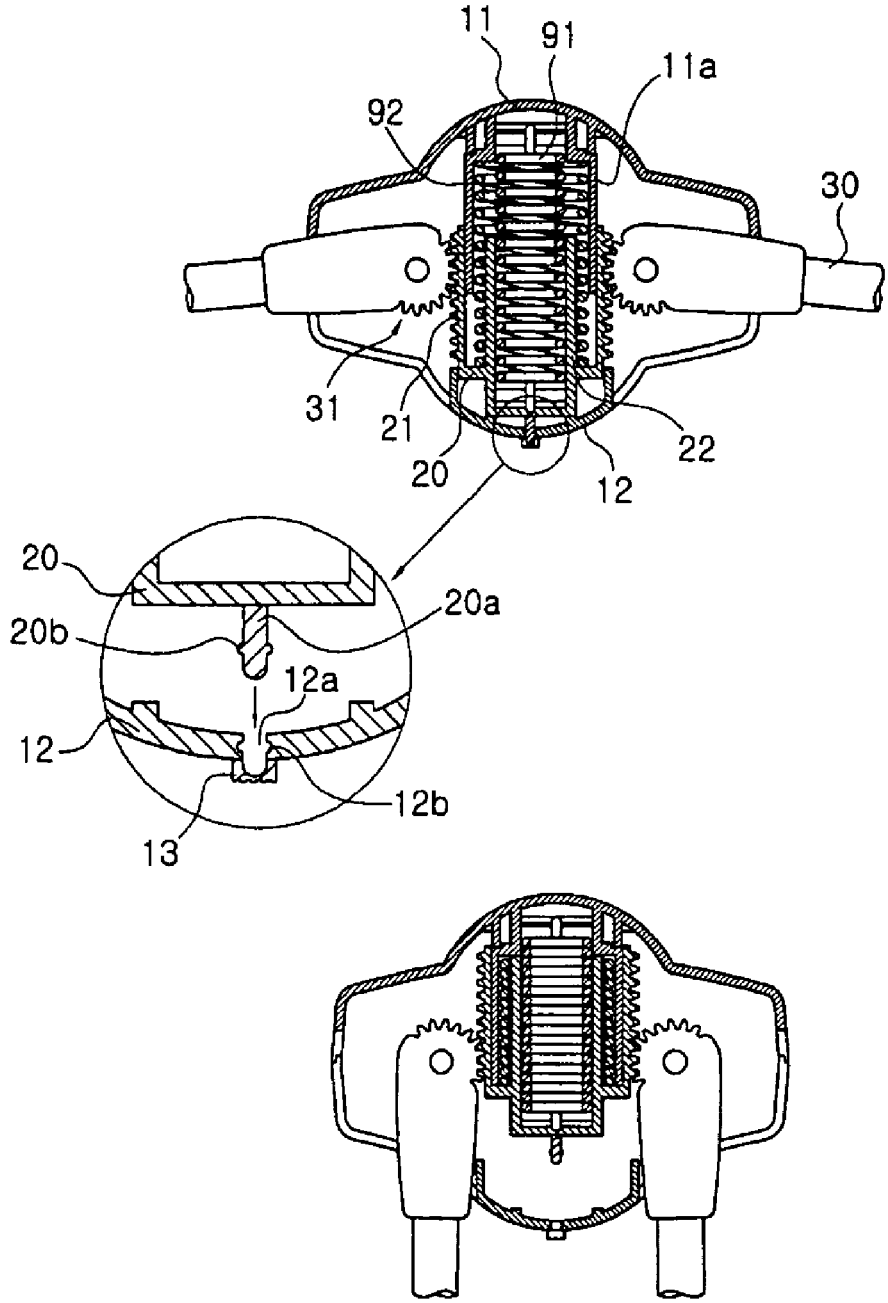
FIG. 3 is an enlarged sectional view of a supporting body included in the tent frame according to the present invention.
Figure 4:
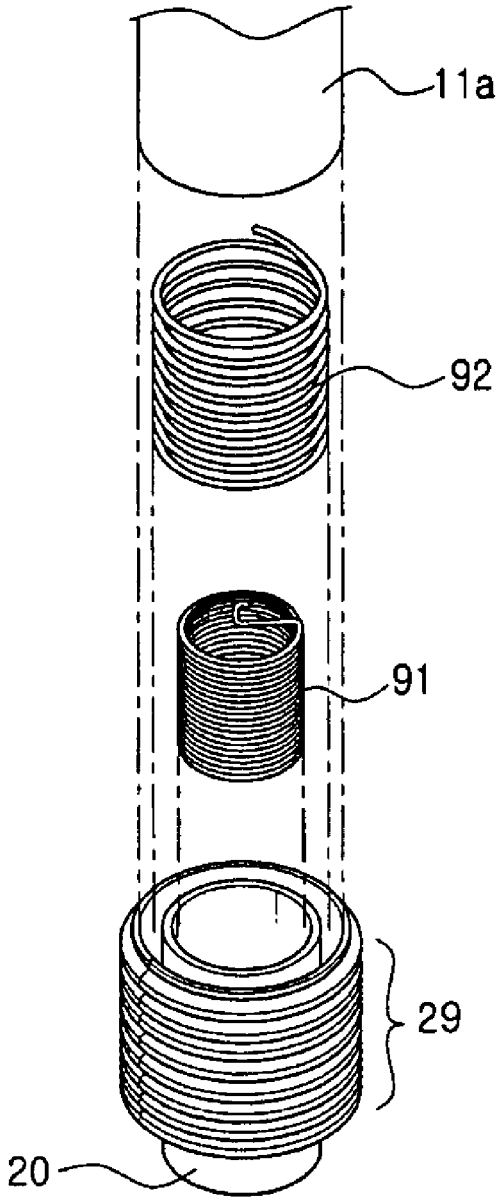
FIG. 4 is an exploded perspective view illustrating the coupling relationship of a bottom-opened cylinder and a columnar slider.

FIG. 3 is an enlarged sectional view of the supporting body 10 included in the tent frame according to the present invention. FIG. 4 is an exploded perspective view illustrating the coupling relationship of a bottom-opened cylinder and a columnar slider.

The supporting body 10, defining an empty interior space, is formed by coupling symmetrical upper and lower cases 11 and 12. Preferably, the supporting body 10 is disc shaped such that it is thicker at the center portion than the remaining portion. Along the outer circumference of the supporting body 10 are formed insertion slots (not shown) for guiding insertion of the main poles 30 to be coupled to the supporting body 10.

Inside the supporting body 10 is mounted a cylinder 11*a*. The cylinder 11*a* has a constant circular cross section, and is opened at the bottom thereof. Such a bottom-opened cylinder 11*a* may be separately fabricated and mounted to the upper case 11. Preferably, the bottom-opened cylinder 11*a* may integrally extend downward from an inner top surface of the upper case 11. A height of the bottom-opened cylinder 11*a* is more than a half of the height of the supporting body 10, and preferably, is approximately in a range of a half to two-thirds of the height of the supporting body 10.

To the bottom-opened cylinder 11*a* is axially coupled a columnar slider 20. The columnar slider 20 is opened at the top thereof, similar to the bottom-opened cylinder 11*a*. As can be seen from FIG. 3, the columnar slider 20 has a dual column structure consisting of an outer column 21 and an inner column 22. The inner column 22 is inserted in the outer column 21 so that their cross sectional centers are concentric relative to each other. Heights of the inner and outer columns 21 and 22 are more than a half of the height of the supporting body 10, and preferably, are approximately in a range of a half to two-thirds of the height of the supporting body 10. Such a configuration is effective to prevent the top-opened columnar slider 20, axially coupled to the bottom-opened cylinder 11*a*, from being separated from the cylinder 11*a*.

On the outer circumference of the outer column 21 is formed racks 29. The racks 29 form gears, having an infinite diameter, along with pinions. Generally, racks and pinions serve to convert rotating movement into rectilinear movement, or vice versa.

The columnar slider 20 has a detention rod 20*a* formed at an outer lower surface thereof. Preferably, the detention rod 20*a* extends downward perpendicular to the lower surface of the columnar slider 20. The detention rod 20*a* has a semi-spherical distal end, and an elastic protruding portion 20*b* is transversely formed along part of the circumference of the detention rod 20*a*.

The lower case 12 is formed at the bottom thereof with a frictional bore 12*a* to allow the detention rod 20*a* to be fitted therein. Part of the inner circumference of the frictional bore 12*a* is transversely formed with a groove 12*b* for the fitting of the elastic protruding portion 20*b*.

The lower case 12 is further formed at the bottom thereof with a switch 13. The switch 13 serves to releasably catch the columnar slider 20, which was downwardly moved to its lowest position.

The switch 13 takes the form of a push button actuatable by manual pushing operation.

Inside the columnar slider 20 is provided first elastic means to provide the columnar slider 20 with an upward movement force. Preferably, as shown, the first elastic means includes a tension spring 91 inserted in the inner column 22, and a compression spring 92 interposed between the outer column 21 and the bottom-opened cylinder 11*a*. The tension spring 91 serves to bear against tension load applied to the slider 20, and the compression spring 92 serves to bear against compression load applied to the cylinder 11*a* and the slider 20.

The main poles 30 are rotatably coupled at their front ends to the supporting body 10 so that they are radially arranged about the supporting body 10. Here, the front ends of the main poles 30 to be coupled to the supporting body 10 are formed with pinions 31 to be engaged with the racks 29.

The racks 29 and the pinions 31 are formed of spur gears or helical gears.

Figure 5:
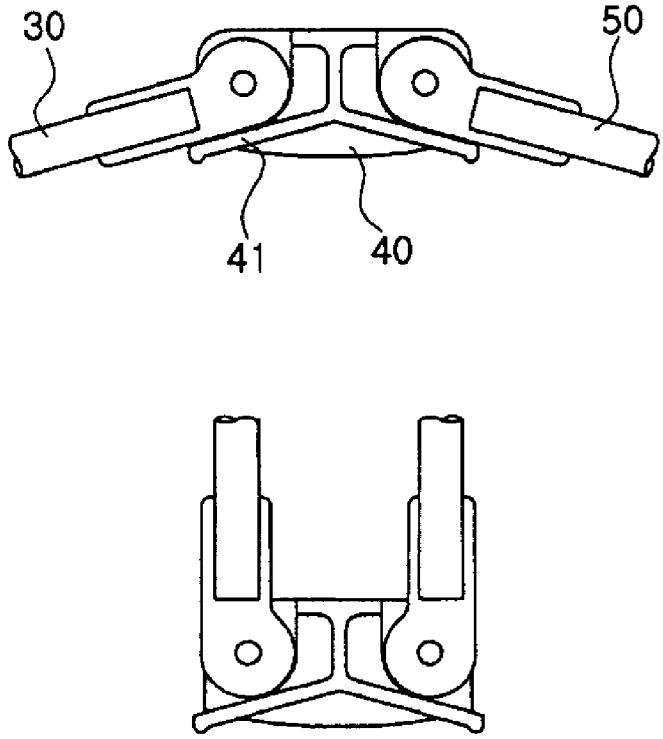
FIG. 5 is an enlarged sectional view of a first folder included in the tent frame according to the present invention.
Figure 6:
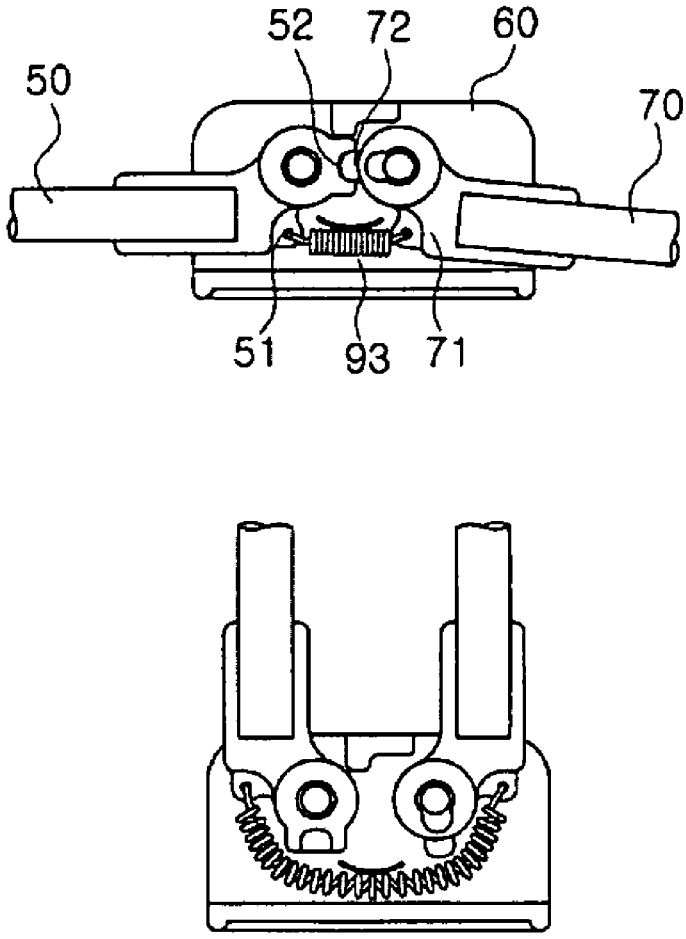
FIG. 6 is an enlarged sectional view of a second folder included in the tent frame according to the present invention.

FIGS. 5 and 6 are enlarged sectional views, respectively, illustrating the first and second folders 40 and 60 of the tent frame according to the present invention.

A rear end of the main pole 30 is rotatably hinged to the first folder 40, and in turn, a front end of the first auxiliary pole 50 is rotatably hinged to the first folder 40. That is, to the first folder 40 are rotatably coupled both the main pole 30 and the first auxiliary pole 50.

The first folder 40 is formed with a stopper 41 to prevent reverse rotation of the main pole 30 and the first auxiliary pole 50. Preferably, as shown in FIG. 5, the stopper 41 has a V-shaped cross sectional form.

A rear end of the first auxiliary pole 50 is rotatably hinged to the second folder 60. The rear end of the first auxiliary pole 50 has a disk shape, and is eccentrically located so that the center thereof is offset from a center axis of the second folder 60 by a predetermined distance. Immediately under the disk-shaped rear end of the first auxiliary pole 50, eccentrically centered relative to the center axis of the second folder 60, is formed a first detention region having a first hole 51. The disk-shaped rear end of the first auxiliary pole 50 has a recess 52 formed along part of the outer circumference thereof.

A front end of the second auxiliary pole 70 has the same or similar disk shape as the rear end of the first auxiliary pole 50, and the disk-shaped front end of the second auxiliary pole 70 is also eccentrically centered relative to the center axis of the second folder 60 to be offset from the center axis by a predetermined distance. Similarly, a second detention region is formed immediately under the front end of the second auxiliary pole 70. The second detention region has a second hole, and the front end of the second auxiliary pole 70 has a protrusion formed along part of the outer circumference thereof.

As mentioned above, to the second folder 60 are rotatably hinged both the rear end of the first auxiliary pole 50 and the front end of the second auxiliary pole 70. Here, the second auxiliary pole 70 is hinged to the second folder 60 so as to allow axial movement thereof within a predetermined distance range. That is, the second auxiliary pole 70 is axially movable by a predetermined distance even after it is hinged to the second folder 60. This is required to fit the protrusion 72 into the recess 52.

To the first and second holes is connected second elastic means. Preferably, the second elastic means includes a tension spring 93 to bear against tension load applied to the first and second auxiliary poles 50 and 70.

Figure 7:
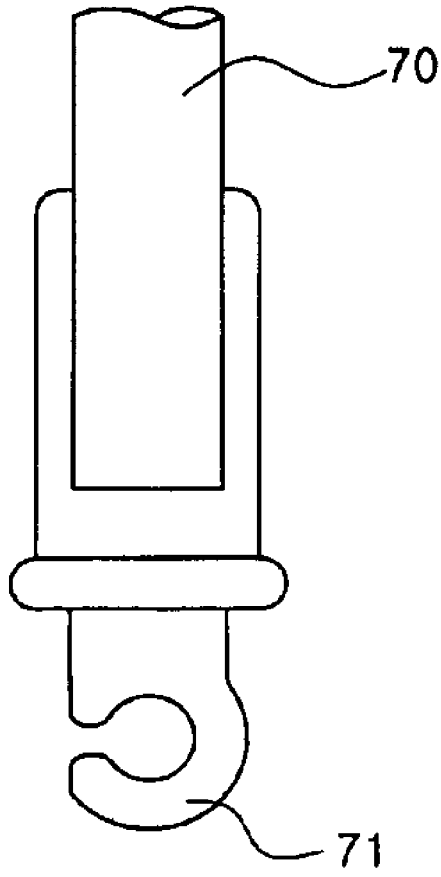
FIG. 7 is an enlarged sectional view of a rear end of a second auxiliary pole included in the tent frame according to the present invention.
Figure 8:
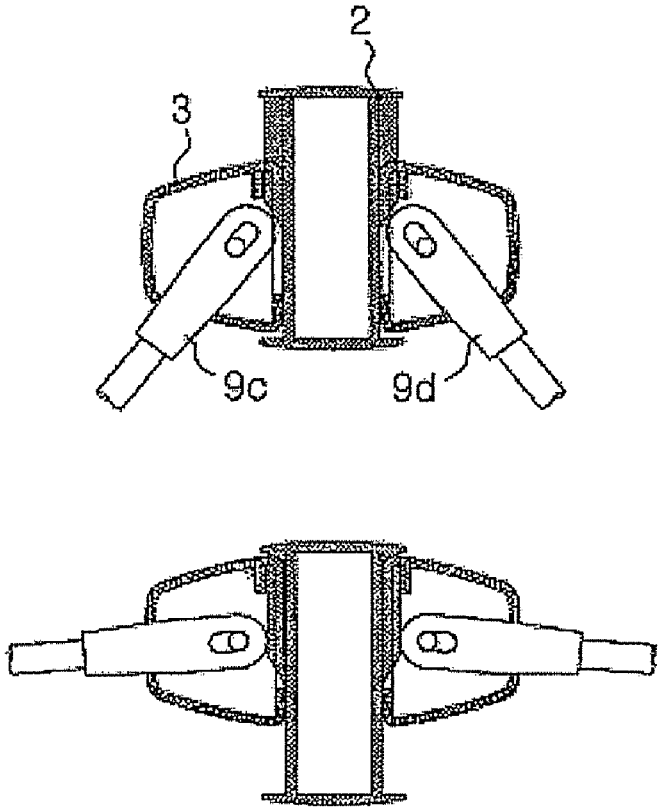
Fig.8 PRIOR ART
FIGS. 8 and 9 are sectional views of a conventional tent frame.
Figure 9:
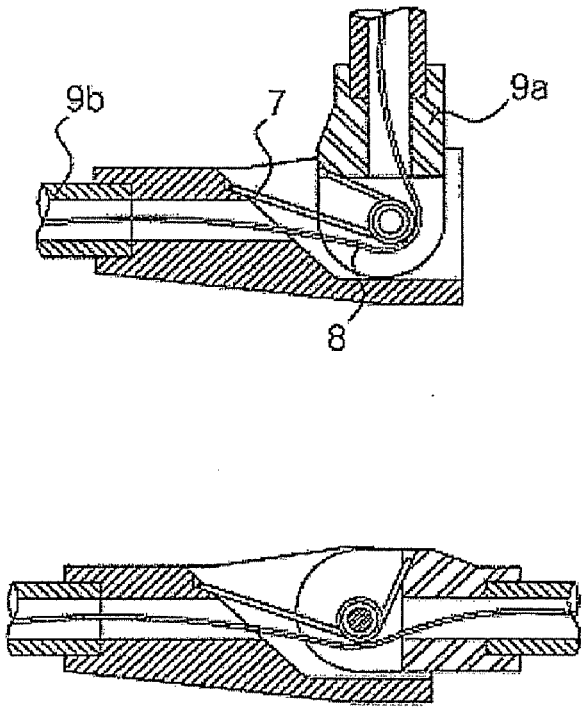
Fig.9 PRIOR ART

FIG. 7 is an enlarged sectional view of a rear end of the second auxiliary pole 70.

Generally, tents are fixed on the ground surface by means of anchors, etc. Therefore, the rear end of the second auxiliary pole 70 is formed with means to be latched to a respective one of the anchors. Preferably, the latch means is a hook 71 easy to be coupled to or separated from the anchor.

Now, the usage example of the tent frame configured as stated above will be explained in detail.

Upon storage, the tent frame of the present invention is folded into three sections to reduce its overall length, increasing storage convenience. In the course of folding the tent frame, the compression spring 92, inserted in the supporting body 10, is compressed, whereas the tension springs 93, located at the respective second folders 60, are tensioned, thus storing elastic potential energy.

In use, the main poles 30 are first unfolded. For this, the main poles 30 are rotated upward to thereby cause the columnar slider 20 to slide downward upon receiving the elasticity of the compression spring 92. After the main poles 30 are rotated to a certain angular range, the detention rod 20*a* is fitted in the frictional bore 12*a*, and the elastic protruding portion 20*b* is fitted in the groove 12*b*, thereby allowing the main poles 30 to be firmly maintained at their unfolded state.

Secondarily, the second auxiliary poles 70 are rotated downward so that the second auxiliary poles 70 are resiliently unfolded about the respective second folders 60 by making use of resilience force of the tension springs 93. Thereby, the second auxiliary poles 70 are easily unfolded without requiring excessive force under the influence of the resilience force of the tension springs 93. It will be clearly understood that the main poles 30 are easily unfolded for the same reason.

After completing unfolding of the second auxiliary poles 70, the first auxiliary poles 50 start to rotate and be unfolded about the second folders 60 upon receiving the resilience force of the tension springs 93. Here, the rotational direction of the first auxiliary poles 50 is controlled by means of their stoppers 41. After the second auxiliary poles 70 and the first auxiliary poles 50 are completely unfolded, the protrusions 72 of the second auxiliary poles 70 are fitted into the recesses 52 of the first auxiliary poles 50 so as to maintain the mutual fixation therebetween.

The dismantlement of the tent frame is performed in reverse order to that described above. That is, the second auxiliary poles 70 are first folded as the protrusions 72 are separated from the recesses 52 by making use of a low force sufficient to overcome the resiliency of the tension springs 93. In order to fold the main poles 30, the supporting body 10 is immobilized and the switch 13 formed at the bottom of the supporting body 10 is pushed to separate the elastic protruding portion 20*b* from the groove 12*b* to thereby push upward the detention rod 20*a* out of the frictional bore 12*a*. As a result, the columnar slider 20 is released from the lower case 12, and moves upward by making use of the resilience force of the tension spring 91. In this case, the linear upward movement of the columnar slider 20 is converted into rotating movement of the pinions 31 engaged with the racks 29, thereby allowing the main poles 30 to be folded.

It should be noted that the folding or unfolding procedure of the main poles 30 and the first and second auxiliary poles 50 and 70 may be changed in consideration of user convenience without being limited to the above description.

As apparent from the above description, the present invention provides a tent frame which can be rapidly and easily folded or unfolded by virtue of a simplified structure thereof.

Further, the tent frame according to the present invention can simply maintain its completely unfolded state.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tent frame comprising:

a hollow supporting body having a bottom-opened cylinder extending downward from an inner top surface thereof;

a columnar slider axially coupled to the bottom-opened cylinder in a vertically movable manner, the columnar slider being formed at an outer circumference thereof with racks;

first elastic means coupled at a first end thereof to the supporting body and at a second end thereof to the columnar slider so as to provide the columnar slider with a vertical movement force; and main poles rotatably coupled around the supporting body so as to be unfolded through rotation, the main poles being formed at their first ends with pinions to engage with the racks of the columnar slider.

2. The frame as set forth in claim 1, wherein the columnar slider includes:

an outer column formed at an outer circumference thereof with the racks; and an inner column concentrically inserted in the outer column, and wherein the bottom-opened cylinder is interposed between the outer and inner columns.

3. The frame as set forth in claim 2, wherein the first elastic means includes:

a tension spring installed in the inner column; and a compression spring interposed between the inner column and the bottom-opened cylinder.

4. The frame as set forth in claim 1, wherein the supporting body is formed with a switch to maintain or release a downwardly moved state of the columnar slider.

5. The frame as set forth in claim 1, further comprising:

first auxiliary poles each having a first end eccentrically located relative to a center axis of an associated one of second folders;

second auxiliary poles each having a first end eccentrically located relative to the center axis of the associated one of the second folders and a second end formed with a hook;

first folders each having a stopper to prevent reverse rotation of the associated first auxiliary pole and main pole, to a respective one of the first folders being rotatably coupled a second end of the associated first auxiliary pole and a second end of the associated main pole;

the second folders each being hingedly coupled with the first end of the associated second auxiliary pole and the first end of the associated first auxiliary pole; and second elastic means coupled at both ends thereof, respectively, to the associated first and second auxiliary poles.

6. The frame as set forth in claim 5, wherein the first end of the first auxiliary pole is formed with a recess, and the first end of the second auxiliary pole is formed with a protrusion to be fitted into the recess.

7. The frame as set forth in claim 5, wherein the second elastic means includes a tension spring.

* * * * *